United States Patent [19]

Rusch

[11] Patent Number: 4,737,639

[45] Date of Patent: Apr. 12, 1988

[54] ENERGY AND ANALYSIS DETECTION SYSTEM FOR SURFACE CHEMICAL ANALYSIS

[75] Inventor: Thomas W. Rusch, Hopkins, Minn.

[73] Assignee: The Perkin-Elmer Corporation, Norwalk, Conn.

[21] Appl. No.: 63,806

[22] Filed: Jun. 24, 1987

Related U.S. Application Data

[63] Continuation of Ser. No. 755,050, Jul. 15, 1985.

[51] Int. Cl.[4] ..... H01J 49/48

[52] U.S. Cl. ..... 250/305; 250/397

[58] Field of Search ..... 250/305, 397

[56] References Cited

U.S. PATENT DOCUMENTS 4,048,498 9/1971 Gerlach et al. ..... 250/305

4,358,680 11/1982 Read ..... 250/305

*Primary Examiner*—Craig E. Church

*Assistant Examiner*—Jack I. Berman

*Attorney, Agent, or Firm*—H. S. Ingham; F. L. Masselle; E. T. Grimes

[57] ABSTRACT

The present invention is directed to an energy analysis and detection system for surface chemical analysis which includes an input lens system for receiving charged particles, said lens system having a first lens stage for definition of analysis area and angular acceptance and a second lens stage for energy adjustment with an aperture assembly interposed between the first lens stage and second lens stage, a spherical capacitor energy analyzer for receiving the output from the input lens system and performing spectroscopic energy resolution, and a detector assembly for receiving the output from the spherical capacitor energy analyzer and detecting the charged particles.

8 Claims, 7 Drawing Sheets

FIRST STAGE OF INPUT LENS @ UNITY MAGNIFICATION

FIRST STAGE OF INPUT LENS @ ABOUT 3X MAGNIFICATION

ENERGY AND ANALYSIS DETECTION SYSTEM FOR SURFACE CHEMICAL ANALYSIS

This application is a continuation, of application Ser. No. 755,050, filed 7/15/85.

FIELD OF INVENTION

This invention relates to analytical instruments, and more particularly to an instrument particularly adapted for surface chemical studies of materials using x-ray photoelectron spectroscopy (XPS or ESCA) and ion scattering spectrometry (ISS) techniques. In addition, the invention can also be used for other spectroscopic techniques which require information on the energy distribution of electrons or ions excited from gaseous, liquid, or solid samples. The present invention is particularly adapted, among other possible uses, for the surface analysis of semiconductors, polymers, and insulating materials used in the semiconductor industry, as well as fracture analysis of glasses, friction and wear studies of bearings, corrosion analysis, adhesion studies of composite materials, catalyst pellet analysis, fracture and failure analysis of metals, magnetic storage media, and optical coatings, for example.

REFERENCES CITED

"Computer Optimization of Retarding Lens Systems for ESCA Spectrometers" by B. Wannberg and A. Skollermo, Journal of Electron Spectroscopy and Related Phenomena 10 (1977), pages 45–78.

BACKGROUND OF INVENTION

ESCA is a technique whereby a solid sample is irradiated with low energy photons causing photoelectrons to be emitted from surface atoms. The emitted photoelectrons are energy analyzed and detected, with the resulting signal acting as a "fingerprint" for elements on the sample surface. The instrument of the present invention measures the kinetic energies of the emitted electrons and from these measurements the elemental and chemical composition of the outermost about 20 atomic layers can be determined.

ISS is a technique whereby a solid sample is bombarded with monoenergetic ions and the energies of the scattered ions are determined. The instrument of the present invention measures the kinetic energy distribution of the scattered ions, and from this measurement, the elemental composition of the single outermost atomic layer can be determined.

It is known to use a movable aperture to restrict the area of analysis down to 250 micrometers. The position of this aperture is not at an image plane in the lens optics, but rather in front of the entire lens assembly. This orientation allows the area of analysis to change with kinetic energy of the detected photoelectrons or ions. However, this lack of constant area leads to data inaccuracies and difficulty in data interpretation. Chemistry from different sections of the sample can contribute to the detected signals, depending on the kinetic energy of the photoelectrons or ions associated with each chemical state. Furthermore, the known lens design does not allow the controlling computer to change the image magnification of the detected ions or photoelectrons. Thus, with the known design, the sensitivity of analysis, directly related to speed of analysis, decreases proportionally with the reduction in analysis area as the operator changes from the large area mode to the small area mode.

It is also known to use a focused x-ray source to define the area of analysis. Because only quartz (100) monochromators are viable for low energy x-ray applications, the monochromator approach forces the user to employ only A1 K$\alpha$x-rays. This limits the chemical systems that can be studied in the small spot mode. In addition, due to the large diameter Rowland circles used in the monochromators of the known system such as, for example, 200–500 mm, the x-ray intensity at the sample surface is low. Although the x-ray flux is refocused through the x-ray monochromator, the resulting ESCA sensitivity is low for the focused x-ray source approach.

SUMMARY OF THE INVENTION

Objects of this invention reside in the provision of an energy analysis and detection system for surface chemical analysis, which provides constant area mode analysis independent of kinetic energy, which provides computer selectable image magnification for small solid angle or large solid angle detection capability, which provides dual polarity energy analyzer controls for both electron spectroscopy and ion scattering spectrometry, and which provides analyzer control for both large area and small area modes of operation using HeI, HeII, NeI, NeII, Mg, K$\alpha$, A1K$\alpha$, SiK$\alpha$, ArL$\alpha$, AnM$\alpha$, AgZ$\alpha$, or TiK$\alpha$ photon sources.

The constant area mode of analysis independent of kinetic energy allows the analyst to use a full range of photo sources for non-destructive depth profiling and enhanced chemical identification while remaining confident that the data originated from a single area, rather than a mixture of areas dependent on kinetic energies.

The computer selectable image magnification allows the operator to trade excellent resolution of angle-resolved ESCA data in the large area mode for enhanced ESCA sensitivity in the small area mode.

The dual polarity energy analyzer controls allow analysis of both negatively charged electrons for ESCA and positively charged ions for ISS. Image magnification selection and adjustable mechanical apertures function for electrons and for positive ions, allowing the analyzer to be used for both large area and small area ESCA and ISS. The focused x-ray source used for small area definition in heretofore known systems did not allow the systems to perform small spot ISS. This eliminated the possibility of using complimentary ESCA and ISS data from the same selected area of analysis to obtain a more complete understanding of the surface chemistry.

In one form of the present invention, the analyzer control electronics permit analysis of electrons from about 0eV to about 4800 eV and positive ions from about 0eV to about 3200 eV, for example. This allows the analyzer to be used for electron spectroscopy for a wide range of ultra-violet sources, e.g. HeI, HeII, NeI, NeII, as well as for x-ray sources from the lower energy MgK$\alpha$ to the higher energy TiK$\alpha$.

To the accomplishment of the foregoing objectives, and additional objects and advantages, which will become apparent as this description proceeds, the invention contemplates in one form thereof the provision of a new and improved energy analysis and detection system for surface chemical analysis, which comprises input lens means for receiving charged particles. This lens means has a first lens stage for analysis area and angular acceptance definition and a second lens stage for energy adjustment. Aperture means are interposed between the first lens stage and the second lens stage. In addition, the system includes a spherical capacitor energy analyzer for receiving the output from the lens means and performing spectroscopic energy resolution. Detection circuitry means are provided for receiving the output from the spherical capacitor energy analyzer and counting the charged particles.

There has thus been outlined rather broadly the more important features of the invention in order that the detailed description thereof that follows may be better understood, and in order that the present contribution to the art may be better appreciated. There are, of course, additional features of the invention which will be described hereinafter and which will form the subject of the claims appended hereto. Those skilled in the art will appreciate that the conception upon which the disclosure is based may readily be utilized as a basis for the designing of other systems for carrying out the several purposes of the invention. It is important, therefore, that the claims be regarded as including such equivalent systems as do not depart from the spirit and scope of the invention.

Several embodiments of the invention have been chosen for purposes of illustration and description, and are shown in the accompanying drawings, forming a part of the specification.

DETAILED DESCRIPTION OF THE PRESENTLY PREFERRED EMBODIMENT

Figure 1:
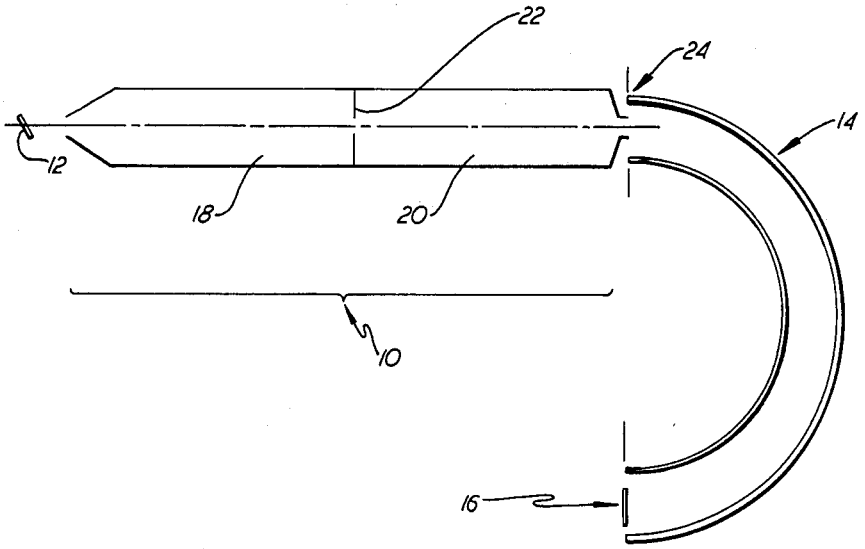
FIG. 1 is a schematic drawing of an energy analysis and detection system for surface chemical analysis according to the present invention.

According to the present invention an energy analysis and detection system for surface chemical analysis comprises input optics or input lens means, indicated generally at 10 in FIG. 1, for receiving charged particles from a sample 12. The input lens assembly or means defines the acceptance area and solid angle of collection of the particles and also acts as a coarse energy filter, focussing only electrons or ions in a moderate kinetic energy range into a 180° energy resolving spherical capacitor energy analyzer (SCA) indicated at 14 in FIG. 1. This analyzer performs the precise spectroscopic energy resolution function. A detection means and associated circuitry, indicated generally at 16, receive the output from the spherical capacitor energy analyzer, amplify the output, and count the charged particles.

The input lens has two distinct sections or stages 18 and 20, as best seen in FIG. 1. The first stage defines the analysis area and angular acceptance by creating an image of the sample 12 on an intermediate aperture plane 22. By placing the selectable aperture at the image plane, the area of analysis can be made constant for either electrons or ions, independent of their kinetic energy. This constant area definition is an improvement over designs known heretofore and is the result of using a non-retarding lens for the first stage. The electrons or ions which pass through the aperture in this plane are then focussed onto the input plane of the SCA 14, indicated at 24 in FIG. 1, with concurrent energy retardation. By separating the area definition stage 18 and energy adjustment stage 20, high sensitivity is then achieved by the optimum choice of potentials in the second stage 20 of the input lens means 10. Because imaging is of secondary importance in the second stage 20 a wider range of lens voltages can be considered in the optimization process.

Figure 2:
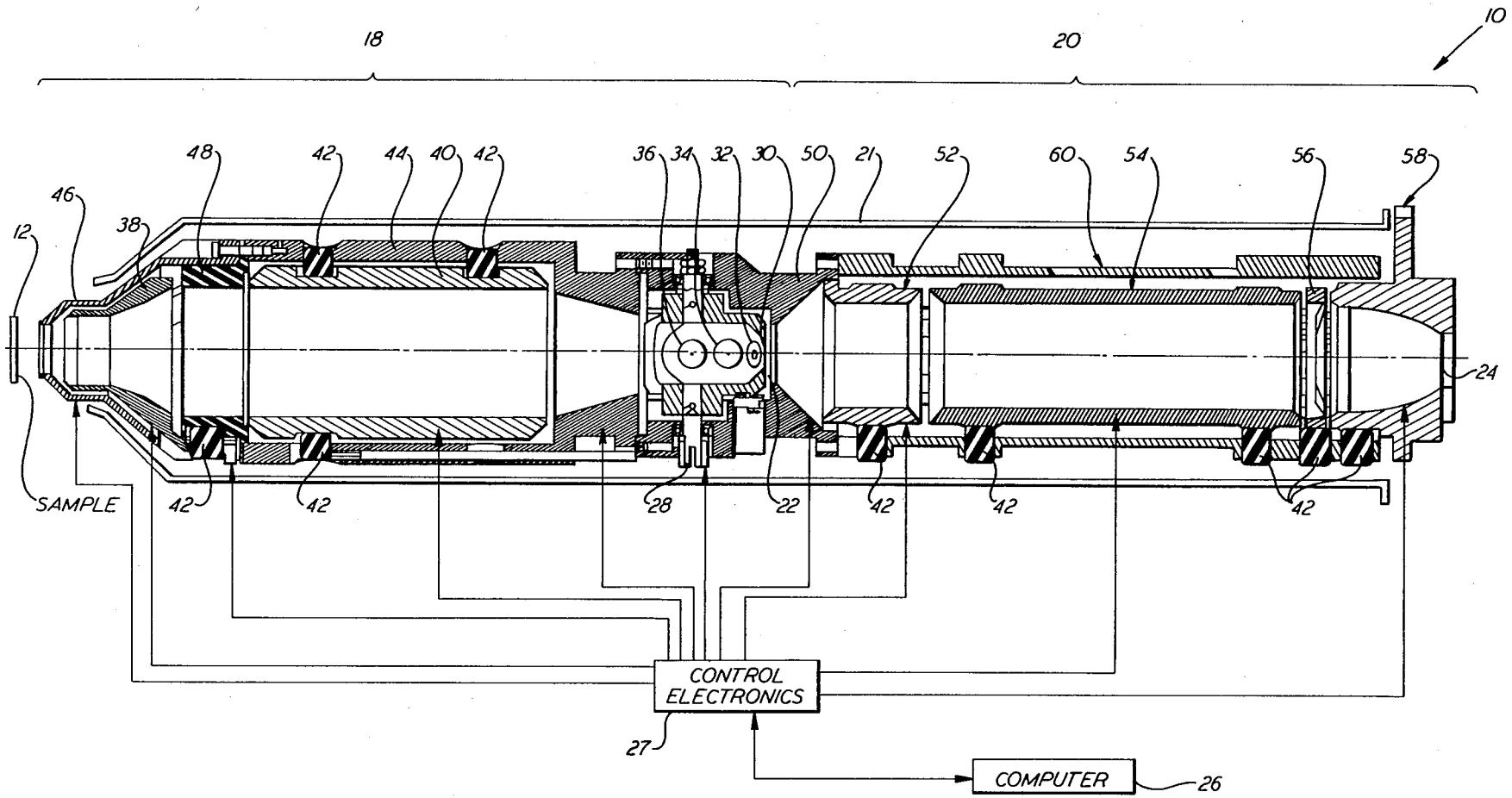
FIG. 2 is a medial cross-sectional view showing details of the lens construction according to the present invention.

Referring to FIG. 2, the illustrated input lens means 10 is a computer 26 controlled, multi-element system enclosed in a cylindrical magnetic shield 21 to eliminate undesirable electron trajectory distortion by stray magnetic fields. The two stages 18 and 20 each have a different function. The front or first stage 18 images electrons or ions leaving the sample 12 onto the plane of the intermediate aperture with a magnification selected through the computer 26 via the control electronics 27. The intermediate aperture assembly 28 includes a set of four mechanically selectable apertures 30, 32, 34 and 36 positionable at the focal plane of the first stage. The apertures used in the preferred embodiment are three circular apertures which have diameters of 0.5 mm, 2 mm, and 4 mm, plus a rectangular aperture with dimensions of 3 mm by 8 mm. By mechanically selecting one of the four intermediate apertures and electronically selecting one of two biasing conditions, the size of the image area can be varied over a wider range such as, for example, areas up to about 3 mm by about 8 mm or areas down to about 200 μm in diameter.

The first stage is composed of two electrically-biasable elements 38 and 40 isolated by insulators 42 from an electrically-grounded frame 44. The frame 44 is further shaped by elements 46 and 48 to provide a lens contour which tailors the electrostatic field distributions to minimize spherical aberration. By varying the voltage applied to elements 38 and 40, the magnification of the lens can be changed from approximately −1 to approximately −5 because the effective position of the lens can be moved from a position approximately mid-way between the sample 12 and aperture plane 22 to a position approximately one-sixth of the distance from the sample 12 to the aperture plane 22.

Figure 3A:
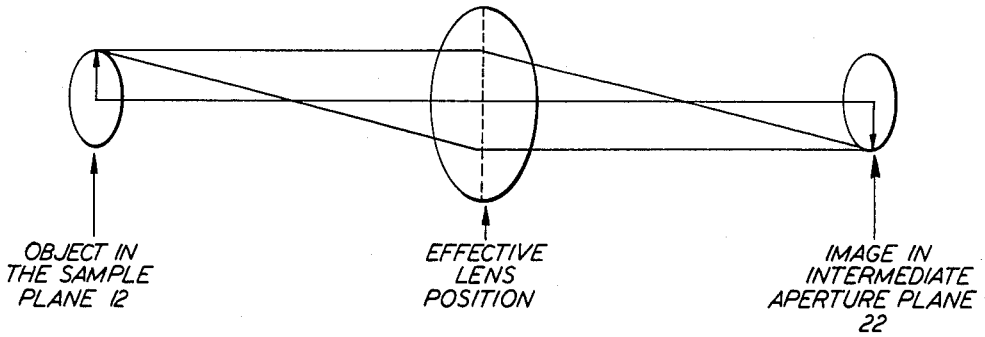
FIGS. 3A and 3B are schematic drawings showing the optical principle governing the variable magnification of the first stage of the lens.
Figure 3B:
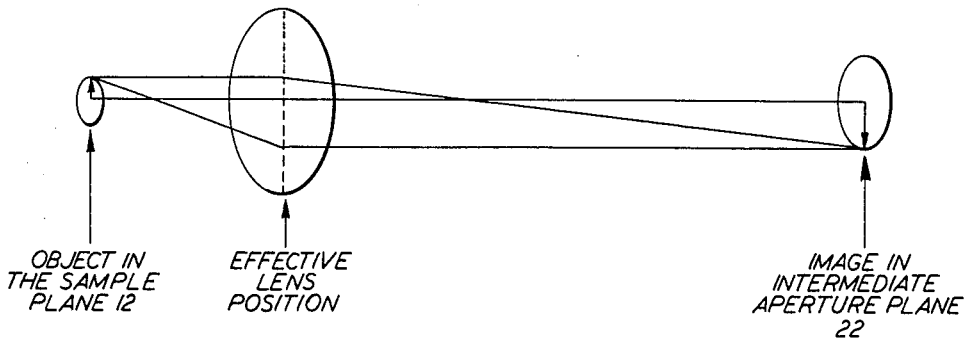

A simple analogy for the first stage operation is shown in FIG. 3A and FIG. 3B using thin lens optics for imaging with visible light. For this type of optical system, the magnification, M, of an object in the sample plane imaged at the image plane is given by the following equation:

$$M = -I/O \quad (1)$$

where O is the distance from the center of the lens to the object and I is the distance from the center of the lens to the image. When the lens position changes and the lens strength is also adjusted in order to maintain fixed positions for the object and image planes, the magnification must change. In the present application, the object size is equal to the analysis area, by definition, and selectively changing the voltages applied to the elements 38 and 40 moves the effective lens position and adjusts the lens strength. Because the image size is defined by and equal to the aperture size, the equation above indicates that each dimension of the analysis area will equal the corresponding aperture dimension divided by the magnification, M, as when in FIGS. 3A and 3B. Furthermore, this last statement implies that in two dimensions the analysis area, A(an), and aperture area, A(ap), are related by:

$$A(an)=A(ap)/M*M \quad (2)$$

An additional principle which governs the operation of each stage of the lens is expressed by the Helmholtz-Lagrange equation which relates the angular distribution of particles which can pass through areas at any two planes in a charged particle optical system. In simple form, the Helmholtz-Lagrange equation is:

$$A(1)*O(1)*E(1)=A(2)*O(2)*E(2) \quad (3)$$

where A(1), O(1), and E(1) are the area of, for example, an aperture in plane 1 of the optical systems, O(1) is the solid angle of the particle distribution passing through plane 1, E(1) is the kinetic energy of particles passing through plane 1, and O(2), and E(2) are the maximum solid angle and kinetic energy, respectively, of the charged particle distribution passing through an area A(2) in plane 2 of the optical system.

The maximum current or signal, S(2) which can pass through an aperture in plane 2 of the optical system is proportional to the product of the aperture area A(2) times the solid angle O(2):

$$S(2)=c*A(2)*O(2) \quad (4)$$

where c is a constant of proportionality. The lens and spectrometer design goal is to maximize the signal, hence, the angular acceptance, within the constraints imposed by the desired analysis area, the overall spectrometer dimensions, and the desired energy resolution.

The energy resolution, dE, of the spherical capacitor energy analyzer can be expressed as:

$$dE=E*(((W1+W2)/2R)+a*a) \quad (5)$$

where E is the pass energy, or the energy to which the analyzer is tuned, W1 is the input slit width in the radial direction, W2 is the exit slit width or effective detector element slit width in the radial direction, R is the mean radius of the analyzer, and a is the half-angle in the radial direction of the input particle distribution. As a increases, the spectrometer transmission function broadens and the spectral peak shape distorts so care must be taken to keep the term a*a less than or approximately equal to the term (W1+W2)/R. By keeping the pass energy, E, constant as the charged particle energy distribution is being measured then constant energy resolution can be maintained.

Figure 4A:
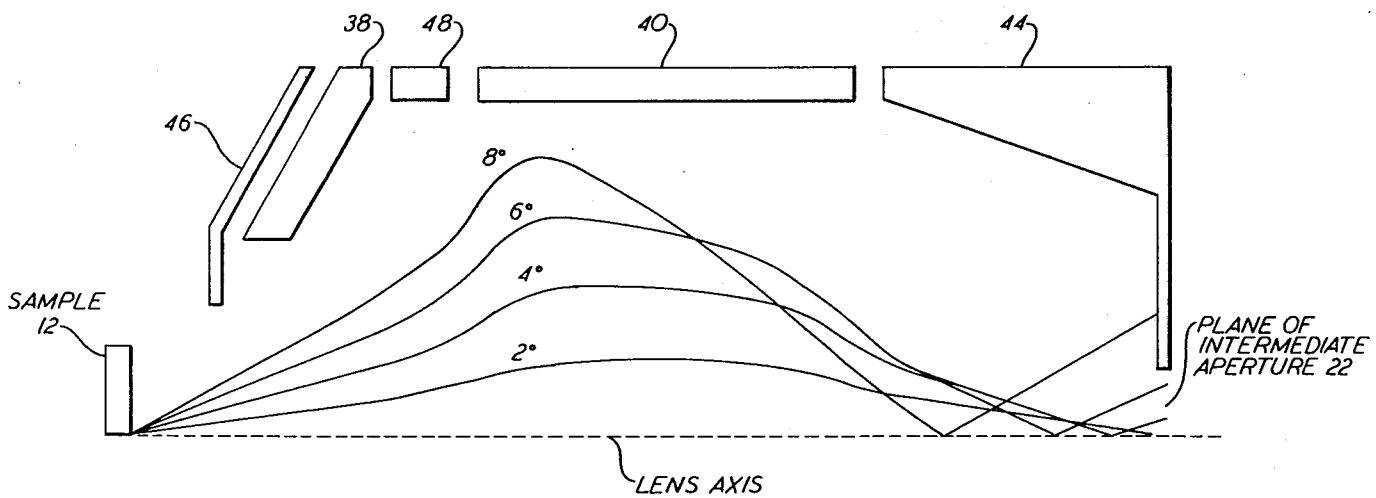
FIGS. 4A and 4B show radial sections of the first stage of the lens with calculated particle trajectories for two operating modes of the present invention.
Figure 4B:
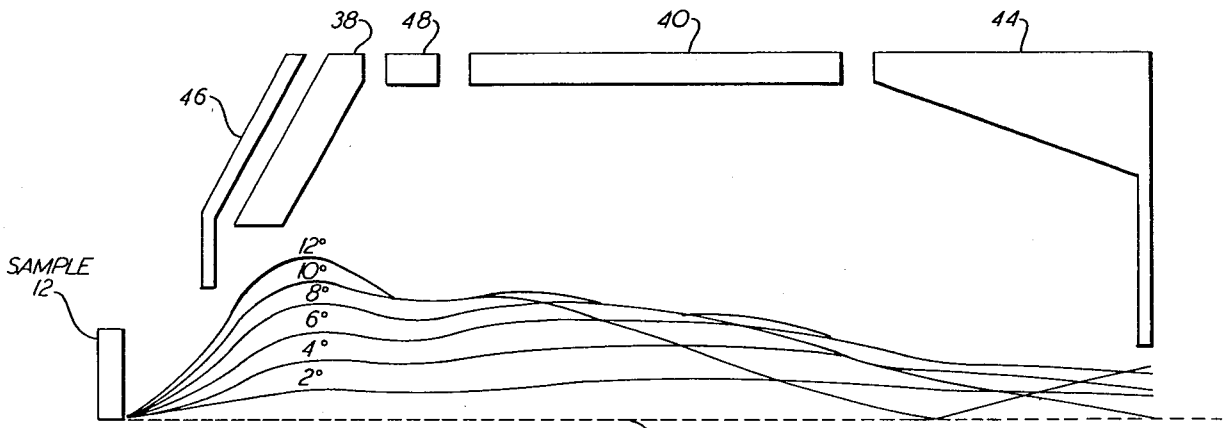
Figure 5A:
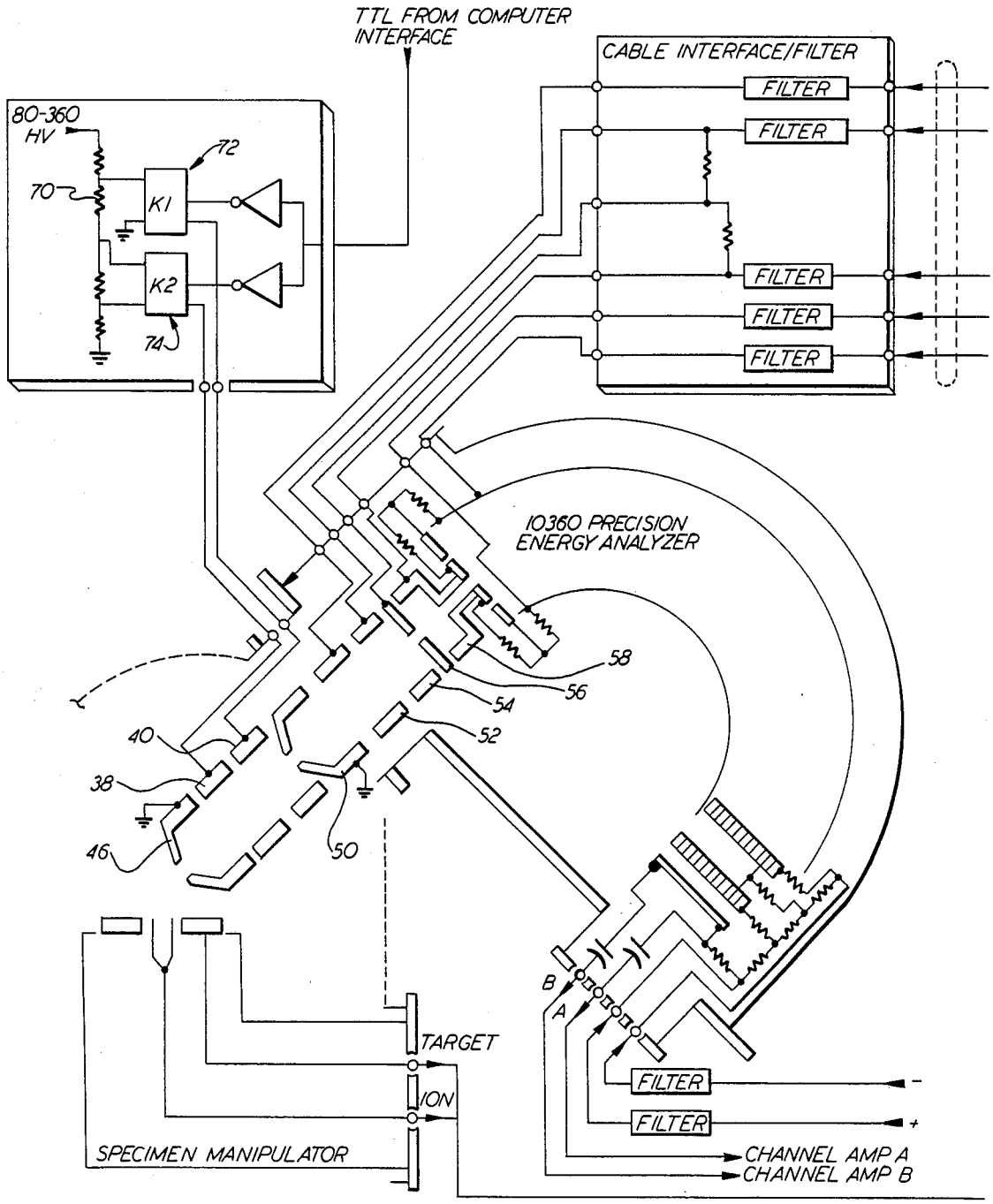

The relationship between this simple thin lens optical analog to the variable magnification input lens is shown schematically in FIGS. 4A and 4B. These figures present a radial section through the first stage with charged particle trajectories which were calculated for optimized electrode shapes and two different sets of lens voltages.

FIG. 4A presents the trajectories for the lens biasing mode which results in unity magnification. The trajectories start on the lens axis at the sample plane with a radical position of zero and at angular inclinations of 2°, 4°, 6° and 8°. Because the analysis area dimensions are approximately equal to the intermediate aperture dimensions, this mode is referred to as the "Large Area" mode. Electrically, the lens has ground potential on electrode elements 44, 46, 48 and 38, and a potential numerically equal to a fraction of the charged particle kinetic energy on element 40. The resultant electrostatic lens is very nearly symmetrically positioned between the sample and aperture planes. As can be seen from FIG. 4A, the trajectories with initial angles which exceed approximately 4° are focussed in front of the aperture plane and are unable to pass through the aperture. Hence, the angular acceptance in this operating mode with unity magnification is approximately 4°.

FIG. 4B presents the trajectories of the lens biasing mode which results in a magnification of approximately 3. The trajectories start on the lens axis at the sample plane with a radial position of zero and at angular inclinations of 2°, 4°, 6°, 8°, 10° and 12°. Because the analysis area dimensions are about ⅓ of the intermediate aperture dimensions, this mode is referred to as the "Small Area" mode. Electrically, the lens has ground potential on electrodes 44, 46 and 48, and potentials numerically equal to fractions of the charged particle kinetic energy on elements 38 and 40. The resultant effective electrostatic lens position is displaced toward the sample plane 12 and causes the magnification to increase. As can be seen from FIG. 4B, the trajectories with initial angles which exceed approximately 10° are focussed in front of the aperture plane and are unable to pass through the aperture. Hence, the angular acceptance in this operating mode with a magnification of 3× is approximately 10°.

The function of the first stage of the lens is to form an electron image of the sample at the intermediate aperture with low aberrations in order to sharply define the analysis area. Because no electron energy modification is necessary in this case, the electrons have the same kinetic energy at both the entrance to and exit from the first stage. This allows the focussing potentials applied to the lens elements to be proportional to the retarding potential applied to analyzer, hence a resistive voltage divider 70 shown in FIG. 5 can be used to derive the lens potentials. However, because the potentials must be different in order to optimize the imaging in each of the operating modes, an output from the computer 26 is used to switch relays 72 and 74 of the control electronics 27, which connect the lens elements 38 and 40 to the optimum points on the voltage divider 70.

In summary, computer control selects the first stage magnification and the solid angle of particle detection. In the large area analysis mode, the acceptance angle can be decreased to + or −4° allowing the analyzer to perform angle-dependent ESCA studies with take-off angles from about 5° to about 90°. This range of take-off angles makes it possible to vary the depth of analysis on smooth surfaces from about 1 to about 20 molecular layers in a non-destructive manner. In the small area mode, the acceptance angle is increased to increase the sensitivity of analysis. This allows the operator to select optimized angle-resolved ESCA results in the large area mode or optimized ESCA sensitivity in the small spot mode.

The second set or stage of lens elements 20 defines the energy of and focusses the electrons or ions onto the entrance plane of the spherical capacitor energy analyzer 14. Referring to the Helmholtz-Lagrange equation, Eq. 3, electrons or ions with kinetic energy E(1) and angular distribution O(1) enter the second stage through the intermediate aperture which has an area A(1). The charged particles are then retarded in energy to a kinetic energy E(2) and focussed onto the analyzer input slit 24 which has an area A(2). Because E(2) is less than E(1), the energy resolution of the spectrometer system is improved and the angular distribution O(2) of the particles at the entrance slit 24 is greater than the angular distribution O(1), hence, the analyzer is more effectively filled so the signal is increased.

Figure 5B:
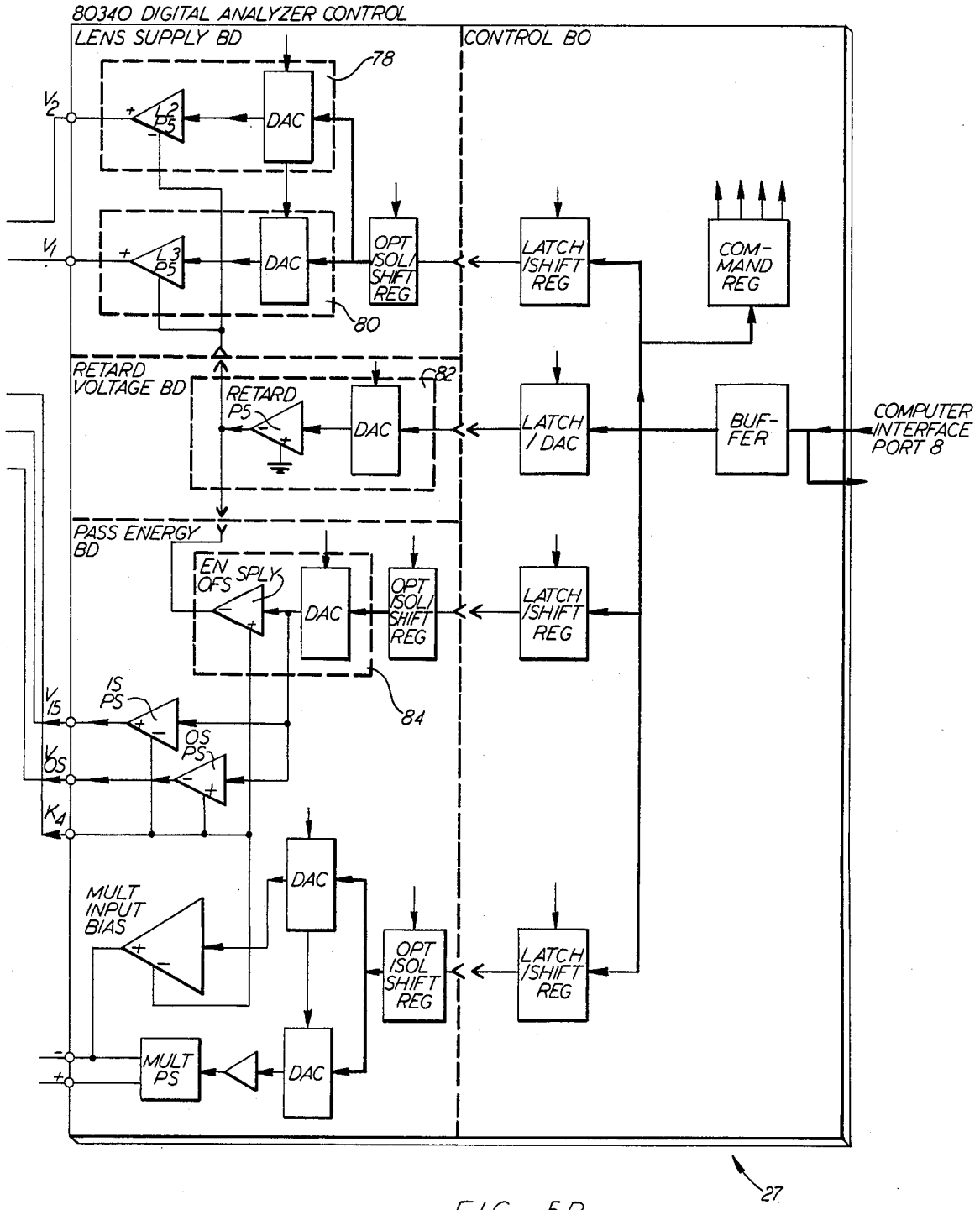
FIG. 5 which consists of FIGS. 5A and 5B is a more detailed schematic of the present invention with the corresponding electronics indicated.
Figure 5:
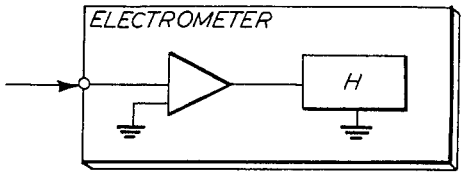
Figure 5:
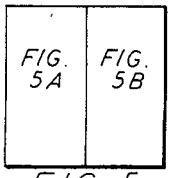

The second stage is composed of four electrically-biasable elements 52, 54, 56 and 58 isolated by insulators 42 from an electrically-grounded frame 60. By applying variable potentials to elements 52, 54, and 58, the charged particles can be retarded and focussed onto the input slit 24 as the electron or ion energy distribution is electronically scanned. The fourth element, 56, is an aperture which limits the angular distribution of particles entering the analyzer in order to maintain acceptable energy resolution as noted in the discussion of Eq. 5. A resistive voltage divider 76 of the control electronics 27, FIG. 5, is used to maintain this aperture at a potential between the potentials applied to elements 54 and 58. The shapes of elements 52, 54 and 58 are adapted from a design by Wannberg and Skollermo (see references).

As noted in the background discussion, it is desirable to maintain a constant analyzer pass energy, hence, a constant exit energy, E(2), as the incoming particle energy, E(1), is scanned. In order to achieve optimal performance in the second stage, a more complex biasing scheme is required for elements 52 and 54 than the resistive biasing scheme described for elements 38 and 40 of the first stage. As shown in FIG. 5, the potentials for elements 52 and 54 are provided by independent, computer controlled power supplies 78 and 80, respectively. The output voltage from power supply 78 is programmed to have the following value with respect to the output of the retarding voltage power supply 82:

$$V(78)=A*V(\text{retard})+B \quad (6)$$

where A and B are constants which depend upon the pass energy being used and V(retard) is the value of the retarding voltage. The output voltage from power supply 80 is programmed to have a constant value with respect to the output of the retarding voltage supply 82. In functional form:

$$V(80)=C \quad (7)$$

where C is a constant which also depends upon the pass energy being used. The values of these constants as a function of pass energy have been determined experimentally and are stored in the computer memory. The voltage for element 58, provided by a third independently programmable power supply 84, has a value with respect to the retarding voltage supply 82 which is numerically equal to the pass energy.

Figure 6:
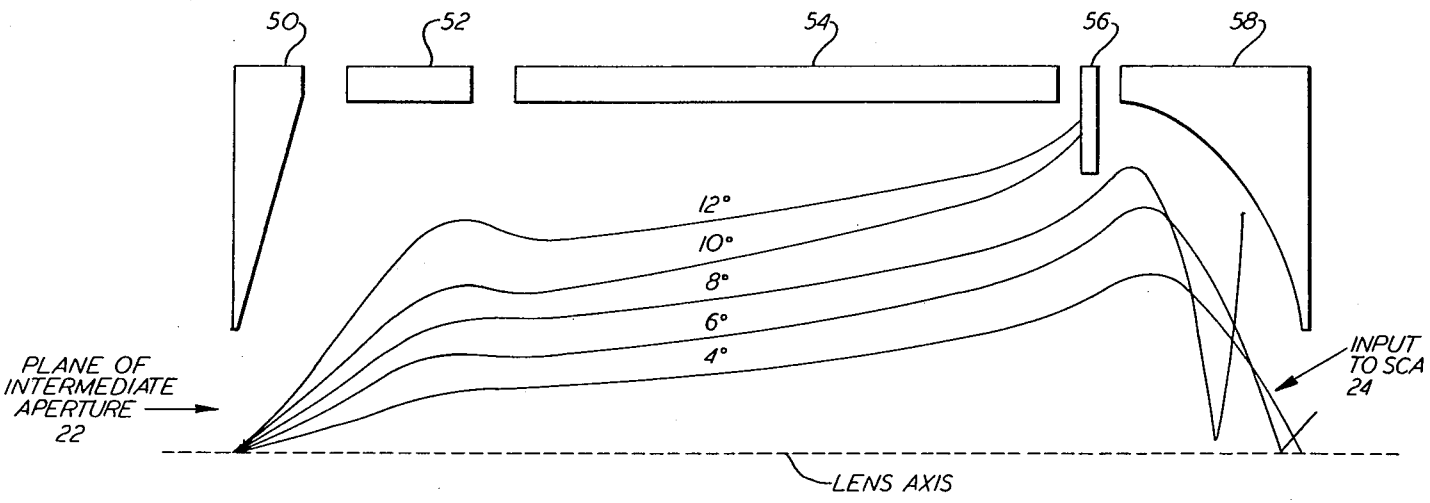
FIG. 6 shows a radial section of the second stage of the lens with calculated particle trajectories.

FIG. 6 presents representative trajectories calculated for charged particles in the second stage for the operating condition in which the particle energy is retarded by a factor of 12. The trajectories originate on the lens axis in the intermediate aperture plane at angular inclinations of 4°, 6°, 8°, 10+ and 12°. In comparison with FIGS. 4A and 4B, the radial trajectory distribution at the input slit to the analyzer is much broader than the trajectory distribution at the output of the first stage. This graphically illustrates the increase in the angular distribution of the particles with retardation in the second stage.

As best seen in FIG. 1, following the energy-defining stage 20 of the lens means 10, the ions or electrons pass through the 180° hemispherical sector analyzer 14 to the detector means 16. This type of analyzer permits the use of either a conventional single channel detector (SCD) or a conventional position sensitive detector (PSD) for electron or ion detection, this modular detector system allows the user to configure a high sensitivity instrument using the PSD detector or a lower cost instrument using the SCD detector, depending on the analytical requirements, and still have the flexibility to update to the other detector in the future.

Figure 7A:
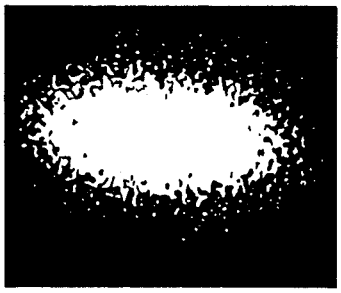
FIG. 7A, 7B, 8A and 8B show scanning electron images of the analysis areas at electron kinetic energies of 250 eV and 1250 eV, which are the end point energies of a typical ESCA survey spectrum exited by Mg K x-radiation.
Figure 7B:
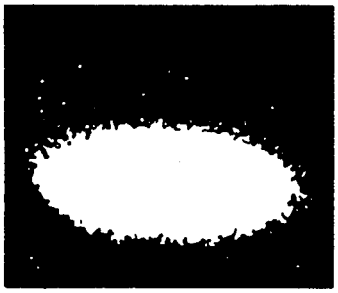
Figure 8A:
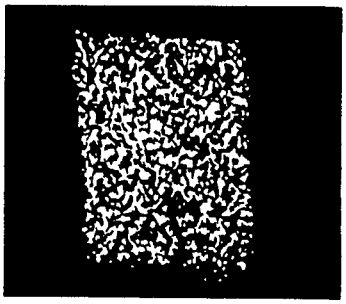
Figure 8B:
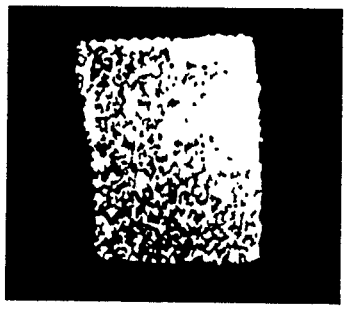

FIG. 7A shows a scanning electron image of an analysis area of 360 micrometer diameter at an electron kinetic energy of 250 eV, while FIG. 7B shows the same area at an electron kinetic area of 1250 eV. FIG. 8A shows a scanning electron image of an analysis area of 2×8 mm at an electron kinetic energy of 250 eV, while FIG. 8B shows the same area at a kinetic energy of 1250 eV. These are the end point energies of a typical ESCA survey spectrum using MgK x-radiation. As can be seen, both the 2×8 mm and the 360 micrometer analysis areas are constant, independent of the electron energy. It is noted that the image elongation in the horizontal direction results from the oblique intersection of both the electron gun and the analyzer axis with sample surface.

There has thus been described a new and improved energy analysis and detection system, which does indeed provide higher sensitivity and more precise analysis area definition than inserting only an aperture ahead of a standard input lens, as was known heretofore. The precise definition of area eliminates the detection of stray electrons or ions which originate outside the area of interest. This lens means according to the invention provides a much wider range of analysis conditions than can be obtained by the use of a heretofore known focused x-ray source. Large area ESCA measurements can be made including depth profiling by use of variable take-off angle and alternative x-ray anodes. By using the input lens system of the present invention, rather than the heretofore known focused x-ray source to define the analysis area, non-destructive depth profiling and Auger parameter measurements can also be made on small areas using alternative x-ray anodes.

Although certain particular embodiments of the invention have been herein disclosed for purposes of explanation, various modifications thereof, after study of the specification, will be apparent to those skilled in the art to which the invention pertains.

What is claimed is:

1. An energy analysis and detection system for surface chemical analysis comprising, in combination:

input lens means for receiving charged particles, said lens means having a first lens stage means for analysis area and angular acceptance definition, said first lens stage means receiving said charged particles from a sample surface and focusing said charged particles substantially without change of energy, said lens means further having a second stage means for energy adjustment and having aperture means interposed between said first lens stage means and said second lens stage means;

spherical capacitor energy analyzing means for receiving the output from said input lens means and performing spectroscopic energy resolution; and detector means for receiving the output from said spherical capacitor energy analyzing means and detecting the charged particles.

2. A system according to claim 1 wherein said input lens means for receiving charged particles includes input lens means for receiving electrons.

3. A system according to claim 1 wherein said input lens means for receiving charged particles includes input lens means for receiving ions.

4. A system according to claim 1 wherein said first stage comprise a plurality of computer controlled imaging lens elements.

5. A system according to claim 4 wherein said second stage comprises a plurality of computer controlled retarding lens elements.

6. A system according to claim 5 wherein said aperture means comprises a plurality of mechanically selectable apertures.

7. A system according to claim 1 wherein said detector means is a single channel detector.

8. A system according to claim 1 wherein said detector means is a position sensitive detector.

* * * * *